United States Patent [19]

Jáki et al.

[11] Patent Number: 4,775,863

[45] Date of Patent: Oct. 4, 1988

[54] SIGNAL DISPLAY ELEMENT FOR THE DISPLAY OF MORE, THAN TWO INFORMATIONS FOR SIGNAL DISPLAYS WITH ELECTROMAGNETICALLY EXCITED TILTING PLATES

[75] Inventors: László Jáki; Sándor Jodál; László Jagicza; József Mandzsu; Endre Pap; János Szebeni, all of Budapest, Hungary

[73] Assignee: Finommechanikai es Elektronikus, Muszergyarto Szovetkezet, Hungary

[21] Appl. No.: 932,733

[22] Filed: Nov. 19, 1986

[30] Foreign Application Priority Data

Nov. 19, 1985 [HU] Hungary ..... 4389/85

[51] Int. Cl.[4] ..... G09F 9/32

[52] U.S. Cl. ..... 340/815.05; 340/815.26; 40/449; 116/204

[58] Field of Search ..... 340/107, 994, 108, 764, 340/815.04, 815.05, 815.15, 815.24, 815.26, 815.29, 785; 40/600, 621, 530, 531, 532, 534, 449, 462; 116/204; 350/269

[56] References Cited

U.S. PATENT DOCUMENTS 2,952,835 9/1960 Aiken ..... 340/815.24

3,916,403 10/1975 Mandzsu et al. ..... 340/815.04

4,528,932 7/1985 Pucza et al. ..... 340/815.26

FOREIGN PATENT DOCUMENTS 0157250 9/1970 Hungary .

0158828 12/1971 Hungary .

*Primary Examiner*—Donald J. Yusko

*Assistant Examiner*—Alvin Oberley

*Attorney, Agent, or Firm*—Handal & Morofsky

[57] ABSTRACT

A signal display element for the display of more than two informations with electromagnetically excited magnetic tilting plates supported in bearings on a baseplate (1 ) and displaced axially in relation to one another, provided with at least one magnetic part each, and the magnetic axes of the magnetic parts (4) are normal to the plane of the tilting plates (3), bipolarly excitable electromagnets are provided for controlling the radiation of the tilting plates (3) about the axis of rotation and on the ends of electromagnetic cores (5) facing the baseplate (1) guide plates (6) are axially displaced, the number of the tilting plates (3) is larger at least by one, than the number of the guide plates (6), but their number is less at least by one, than the power of two with an exponent corresponding to the number of cores (5).

12 Claims, 3 Drawing Sheets

SIGNAL DISPLAY ELEMENT FOR THE DISPLAY OF MORE, THAN TWO INFORMATIONS FOR SIGNAL DISPLAYS WITH ELECTROMAGNETICALLY EXCITED TILTING PLATES

FIELD AND BACKGROUND OF THE INVENTION

The present invention relates to a signal display element for the display of more than two informations for signal displays with electromagnetically excited tilting plates, having base plates, tilting plates supported in bearings and displaced axially in relation to each other, provided with at least one magnetic part and the magnetic axes of the magnetic parts are normal to the plane of the tilting plates, furtheron, bipolarly excitable electromagnets are contained which are well suitable for the control of the tilting plates; on the ends of the electromagnetic core facing the base plate guide plates parallel with the base plate are arranged.

As it is well known, signal display elements for the visual display of numbers, signals, symbols used to be applied such, as disclosed in Hungarian Patent HU-PS 157 250, which are provided with plates having magnetic parts and to be tilted by electromagnetic control and in such a manner that under the influence of the tilting motion one or the other face of the plates becomes visible, the plates can be tilted around a lateral edge or another edge being parallel with the lateral edge; the two surface of the tilting plates are carrying different informations, e.g. they are differently colored, while the part of the baseplate which became visible, carries an identical information this means, that it has the same color as the surface of tilting plate which became visible. The tilting plates are made—at least partly of a permanent magnetic material, and the magnetic axis thereof runs preferably perpendicular to the plane of the tilting plates. Accordingly, by the application of the signal display element two different informations can be displayed.

Furthermore, an element based on the principle of the previously described signal display is known, which is suitable for the display of more than two informations. This type of signal display element is specified in Hungarian Patent HU-PS 158 828. With this solution, in contrast to the earlier solution the axes of rotation of the signal display elements are not fixedly supported in bearings, but may move guided in the inside of U-shaped (hairpin) bearings, similarly, as books respectively covers provided with filler sheets. With this solution a plurality of tilting plates can be arranged in one tilting element and the number of displaying information is larger by one, than the number of the tilting plates (the same relates to the number of colors).

With both solutions the thickness of the single tilting plates is determined by required thickness (the required magnetic energy content) of the magnets with a magnetic axis being preferably normal to the plane of the tilting plates. The latter solution containing more tilting plates requires as many field coils, as the number of the tilting plates contained in the signal display element.

The invention is based on the recognition, with respect to a properly coded control of the field coils, and more particularly, if a plurality of tilting plates are applied in one signal display element, the number of the field coils can be considerably less, than the number of the tilting plates.

The essence of the invention lies in that the guide plates belonging to one signal display element are arranged with an axial displacement, while the number of the tilting plates is larger at least by one, than the number of the guide plates, however, it is less at least by one, than a power of two with an exponent corresponding to the number of the electromagnetic cores.

BRIEF DESCRIPTION OF THE DRAWINGS

The invention will be described in detail by means of preferred embodiments serving as examples, by means of the drawings enclosed, wherein:

FIG. 2 illustrates the possibility of "turning the pages" of the tilting plates in the signal display element according to the embodiment of FIG. 1, by changing the excitation of the guide plates, while

DESCRIPTION OF THE PREFERRED EMBODIMENTS

Figure 1:
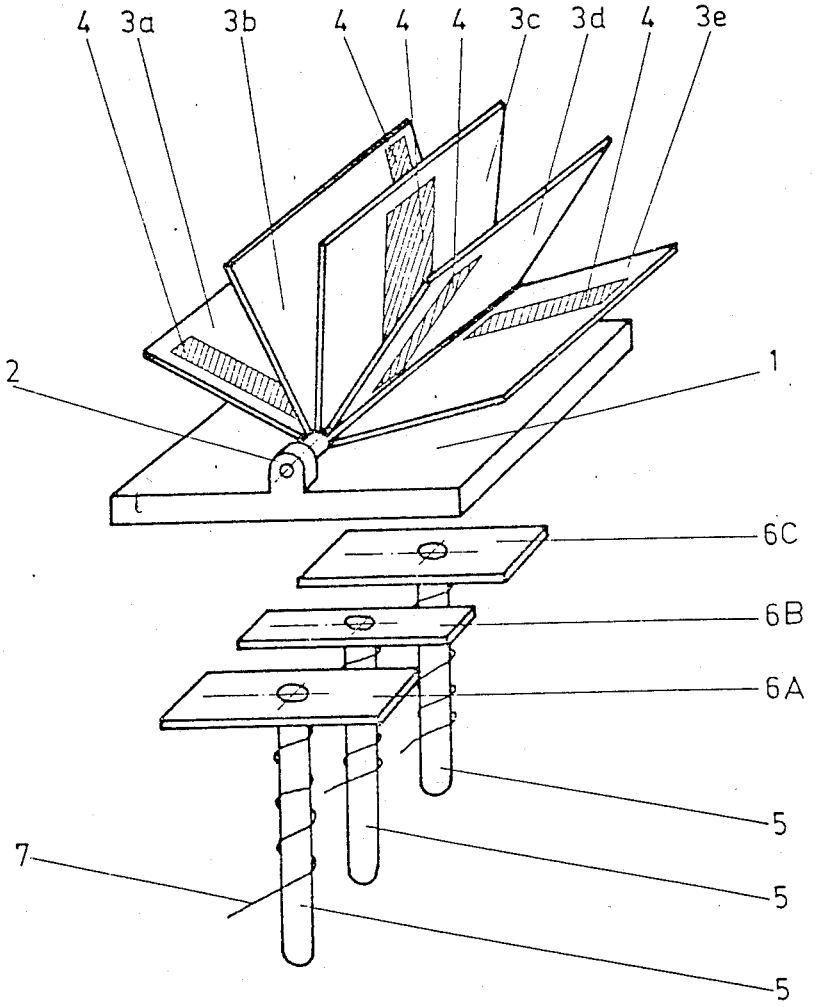
FIG. 1 is an axonometric scheme of an embodiment of the invention with five tilting plates and three guide plates.

On a baseplate 1 of the signal display element according to FIG. 1 tilting plates 3 are supported in bearings 2 in a rotatable manner. On tilting plates 3 the magnetic parts 4 are arranged, which are displaced in relation to each other in direction of the axis of rotation of the tilting plates 3. The magnetic axes of the magnetic parts are normal to the plane of the tilting plates 3.

On the side of the baseplate 1 lying opposite to the displaying surface bipolarly excitable electromagnets are arranged, which are well suitable for the control of the tilting plates 3, while on the end of the cores of the electromagnets 5 facing the baseplate, guide plates 6, preferably parallel with the baseplate 1, are arranged. In case of the embodiment shown here on the cores of the electromagnet 5 field coils 7 are to be found.

Figure 2:
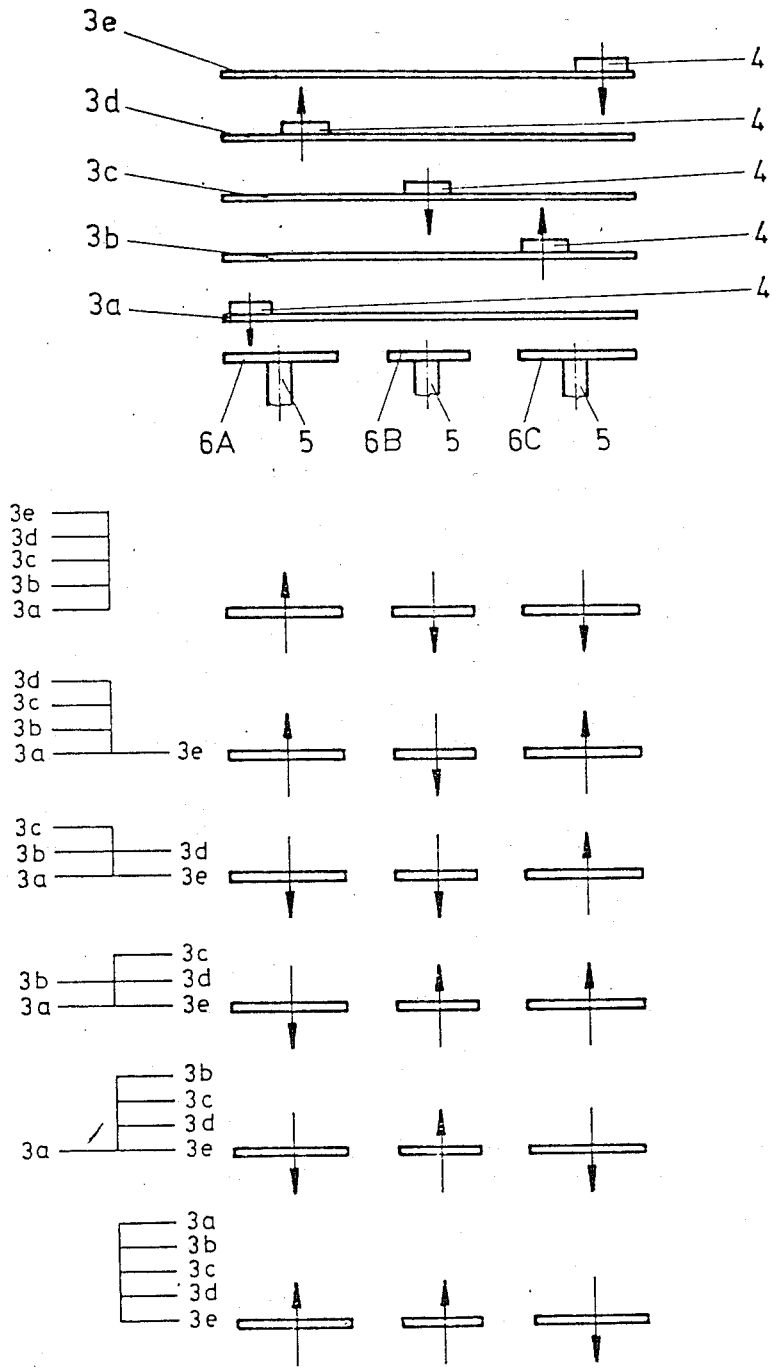

FIG. 2 shows the view of the tilting plates according to FIG. 1, being parallel with the baseplate 1 and normal to the axis of the tilting plates 3; on the bottom of the figure change of the polarity of the guide plates 6 can be seen, in the single steps of turning the tilting plates 3 from one stable condition into the other stable condition.

According to the embodiment serving here as an example, from the tilting plates 3, two tilting plates are associated or assigned to the two extreme guide plates 6, while a separate tilting plate 3 is assigned to the central guide plate 6. In such a manner the number of the guide plates amounts to three.

The central tilting plate 3 is assigned to the central guide plate 6, however, the adjacent tilting plates 3 are not ordered to the extreme guide plates 6. The magnetic parts on the tilting plates 3 are arranged so, that (a) in any stable position the polarity of the magnetic parts 4 on two adjacent tilting plates 3 is of opposite direction, (b) in any stable position the magnetic parts 4 on any two adjacent tilting plates 3 are in a magnetic relation with two different guide plates 6, (c) from the guide plates 6 at least one guide plate 6 remains in a magnetic relation with odd-numbered tilting plate 3 and the guide plate 6 is arranged among the other guide plates 6 about in the centre, (d) polarity of the magnetic parts 4 following one another axially is of opposite sign.

In order to be able to explain the mode of operation of the signal display element according to the invention, in FIG. 2 the five tilting plates 3 are indicated one after the other with the indices a, b, c, d, e, while the guide plates 6 are indicated with the indices A, B and C. In FIG. 2 the polarity of the magnetic parts 4 is also illustrated, while direction of the excited polarities are indicated below each other for the different arrangements of the tilting plates 3 (when "turning the pages").

In the starting position, in one of the stable positions, in the position on the left-side of FIG. 2, all the tilting plates 3 are lying on one another. The guide plate $6_A$ is magnetically connected to the tilting plates $3_a$ and $3_d$, the guide plate $6_B$ to the tilting plate $3_c$ and the guide plate $6_C$ to the tilting plates $3_b$ and $3_e$. In this position the guide plate $6_A$ has a north-polarity, while the guide plates $6_B$ and $6_C$ have south-polarities.

The topmost tilting plate $3_e$ can be tilted so, if the polarity of the guide plate 6 being in a magnetic relation therewith is changed. Now the guide plate $6_c$ has a north-polarity, accordingly it repels the tilting plate $3_e$, while the other tilting plate $3_b$ being in a magnetic connection with the guide plate $6_C$ will be attracted.

For tilting the next tilting plate $3_d$ the guide plate $6_A$ being magnetically connected thereto is to be repolarized. Accordingly, the guide plate $6_A$ will be south-polarized, simultaneously the other tilting plate $3_a$ connected to the guide plate $6_A$ becomes attracted.

As the guide plates 6 are arranged symmetrically with the axis of rotation of the tilting plates 3, on the other side the tilting plates $3_c$ and $3_d$ become attracted.

The central tilting plate $3_c$ is tilted by reversing the polarity of the guide plate $6_B$ being in a magnetic connection therewith. On the other side there are now three tilting plates $3_e$, $3_d$, $3_c$ and all of them are in an attracted state.

To tilt the tilting plate $3_b$—the plate before the last one—the polarity of the guide plate $6_C$ connected magnetically thereto is to be reversed, as a consequence, the tilting plate $3_e$ being attracted up to now will be repelled. However, this repelling cannot come into force, as on the other side still two tilting plates $3_d$ and $3_c$ being attracted, now the third one, the tilting plate $3_b$ having been tilted in the course of the above operation, is added to them too.

At last, the last tilting plate $3_a$ is tilted so, that the polarity of the guiding plate $6_A$ being in magnetic contact therewith is reversed. Now, the tilting plate $3_d$, the second from the bottom is repelled on the other side. However, this repelling cannot come to force, as the tilting of the tilting plate $3_a$ keeps the number of the tilting plates 3 in prevalence.

Figure 3:
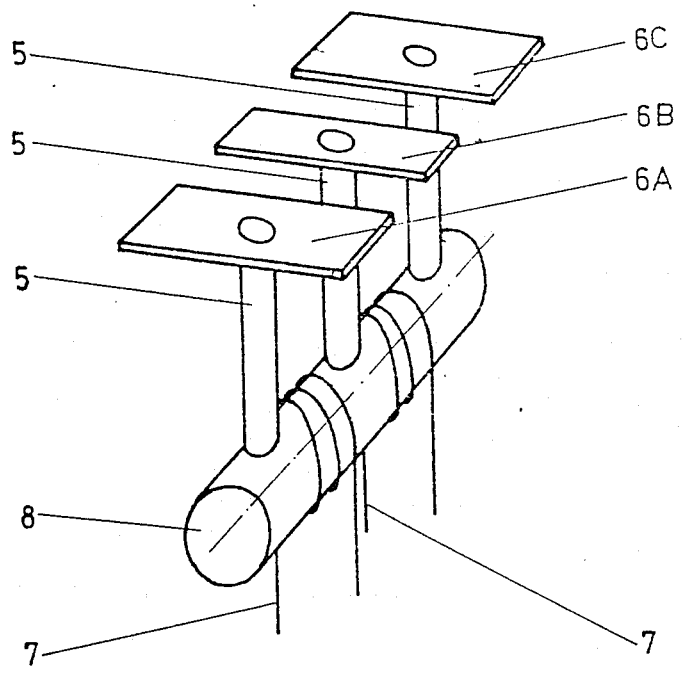
FIG. 3 illustrates a third possible embodiment of the invention with three guide plates and two field coils.

FIG. 3 illustrates an embodiment, with which the number of the field coils 7 is less by one, than the number of the guide plates 6, respectively the number of the electromagnetic cores 5 to associated the guide plates 6. This can be achieved, according to the example by embodiment herein described, in such a manner that the cores 5 or at least a part of the cores 5 are bridged over or shunted by a coupling member 8 to be fitted closely to the cores 5, made of a soft magnetic material and ensuring the division of the magnetic core at the end of the cores 5 lying opposite to the baseplate 1. In this case the cores 5 are made of a hard magnetic material with repolarisable remanent magnetic induction.

Guide plates 6 may be prepared of a soft magnetic material, while a soft magnetic material can be used also for the cores 5, if they are not bridged over by the coupling member 8.

It could be demonstrated that by means of n guide plates 6, $2^n-1$ tilting plates can be tilted in a controlled manner. Accordingly, in the figures, where the number of the guide plates 6 amounts to three, $2^3-1=7$ pieces of the tilting plates 3 can be tilted, of which five are illustrated here.

The invention is not restricted to the solutions according to the examples, but they extend to all the solutions contained in the claim, in particular in the main claim.

What we claim is:

1. Signal display element for the display of more than two informations comprising electromagnetically excited magnetic tilting plates, a baseplate, said tilting plates being supported for rotation about an axis in bearings on the baseplate and displaced around the axis in relation to one another, said tilting plates each including at least one magnetic part, the magnetic axes of the magnetic parts are normal to the plane of the tilting plates, bipolarly excitable electromagnets each coupled electromagnetically to an associated one of said magnetic parts for controlling the tilting plates, on the ends of electromagnetic cores of said electromagnets facing said baseplate, guideplates preferably parallel with the baseplate are arranged, the guideplates each being associated with one tilting plate are axially displaced, the number of the tilting plates is larger at least by one than the number of the guide plates, the number of the tilting plates which can be energized is defined by the following relationship:

$$\text{Number of tilting plates}=2^n-1;$$

wherein n is the number of the electromagnetic cores, and wherein the number of the tilting plates which can be energized is also defined by the following relationship:

$$\text{Number of tilting plates}=2^n-1;$$

wherein n is the number of the guide plates.

2. Display element as claimed in claim 1, characterized in that the guide plates (6) are formed of a soft magnetic material.

3. Signal display element as claimed in claim 1, characterized in that the electromagnetic cores (5) are made of a hard magnetic material with reversable polarity and remanent magnetic induction.

4. Signal display element as claimed in claim 1, characterized in that the electromagnetic cores (5) are formed of a soft magnetic material with an initial permeability, which is less, than the initial permeability of the guide plates (6).

5. Signal display element as claimed in claim 1, characterized in that in any stable position the polarity of the magnetic parts (4) on any two adjacent tilting plates (3) is of opposite sign.

6. Signal display element as claimed in claim 1, characterized in that in any stable position the magnetic parts (4) on any adjacent two tilting plates (3) are magnetically connected to two different guide plate (6).

7. Signal display element as claimed in claim 1, characterized in that at least one of the guide plates (6) is magnetically connected to an odd-numbered tilting plate (3).

8. Signal display element as claimed in claim 1, characterized in that the polarity of the magnetic parts (4) following axially one another is of opposite sign.

9. Signal display element as claimed in claim 1, characterized in that initial permeability of the guide plates (6) having been formed of a soft magnetic material is higher, than the initial permeability of the electromagnetic core (5) connected to the guide plates (6).

10. Signal display element for the display of more than two informations comprising electromagnetically excited magnetic tilting plates, a baseplate, said tilting plates being supported for rotation about an axis in bearings on the baseplate and displaced around the axis in relation to one another, said tilting plates each including at least one magnetic part, the magnetic axes of the magnetic parts are normal to the plane of the tilting plates, bipolarly excitable electromagnets each coupled electromagnetically to an associated one of said magnetic parts for controlling the tilting plates, on the ends of electromagnetic cores of said electromagnets facing said baseplate, guideplates preferably parallel with the baseplate are arranged, the guideplates each being associated with one tilting plate are axially displaced, the number of the tilting plates is larger at least by one than the number of the guide plates, the number of the tilting plates which can be energized is defined by the following relationship:

$$\text{Number of tilting plates} = 2^n - 1;$$

wherein n is the number of the electromagnetic cores, and wherein the electromagnetic cores are made of a hard magnetic material with reversible polarity and remanent magnetic induction, and wherein at least a part of the cores is shunted with a coupling member to be fitted closely to the cores, said coupling member being formed of a soft magnetic material, ensuring magnetic distribution, at the ends of the cores lying opposite to the baseplate.

11. Signal display element as claimed in claim 10, characterized in that at least a part of the field coils (7) of the electromagnets is arranged on the coupling member (8).

12. Signal display element as claimed in claim 11, characterized in that the number of the field coils (7) is less by one, than the number of the cores (5).

* * * * *